US009198499B2

(12) United States Patent
Kim

(10) Patent No.: US 9,198,499 B2
(45) Date of Patent: Dec. 1, 2015

(54) HAIRBRUSH

(71) Applicant: Chang Ku Kim, Seoul (KR)

(72) Inventor: Chang Ku Kim, Seoul (KR)

(73) Assignee: Chang Ku Kim, Seoul (KR)

( * ) Notice: Subject to any disclaimer, the term of this patent is extended or adjusted under 35 U.S.C. 154(b) by 0 days.

(21) Appl. No.: 14/312,918

(22) Filed: Jun. 24, 2014

(65) Prior Publication Data

US 2015/0128366 A1 May 14, 2015

(30) Foreign Application Priority Data

Nov. 13, 2013 (KR) ..... 10-2013-0137376
Apr. 29, 2014 (KR) ..... 10-2014-0051255

(51) Int. Cl.
*A46B 3/18* (2006.01)
*A46B 9/12* (2006.01)
*A46B 9/02* (2006.01)

(52) U.S. Cl.
CPC . *A46B 9/023* (2013.01); *A46B 3/18* (2013.01); *A46B 9/12* (2013.01); *A46B 2200/104* (2013.01)

(58) Field of Classification Search
CPC .... A46B 2200/104; A46B 3/18; A46B 15/00; A46N 9/00; A46N 9/02; A46N 9/026; A46N 9/028; A46N 9/023; A46N 9/08; A46N 9/10; A46N 9/12
USPC ..... 15/168, 206; 132/120
See application file for complete search history.

(56) References Cited

U.S. PATENT DOCUMENTS

| | | | | |
|---|---|---|---|---|
| 4,167,192 | A * | 9/1979 | Arnold | 132/212 |
| 2003/0070244 | A1* | 4/2003 | McEntyre et al. | 15/160 |
| 2007/0174986 | A1* | 8/2007 | Park | 15/206 |
| 2009/0165234 | A1* | 7/2009 | Bernat Bernat | 15/160 |
| 2011/0017226 | A1* | 1/2011 | Choi | 132/120 |

* cited by examiner

*Primary Examiner* — Mark Spisich

(57) ABSTRACT

In a hairbrush including a brush body having bristles twisted and fixed to a twisted wire and a porous cylindrical body having holes at a uniform interval and coupled to the brush body such that the bristles of the brush body are elastically exposed to the outside of the porous cylindrical body by a predetermined length, the porous cylindrical body is formed by curving a mesh plate in the shape of a roll and fixing the both side ends of the mesh plate to each other, and the bristles of the brush body are elastically exposed through the mesh holes of the porous cylindrical body.

8 Claims, 11 Drawing Sheets

< PRIOR ART >

< PRIOR ART >

< PRIOR ART >

(a)

(b)

(c)

< PRIOR ART >

HAIRBRUSH

CROSS-REFERENCE TO RELATED APPLICATION

This application claims priority of Korean Patent Application No. 10-2013-0137376, filed on Nov. 13, 2013, and priority of Korean Patent Application No. 10-2014-0051255, filed on Apr. 29, 2014, in the KIPO (Korean Intellectual Property Office), the disclosure of which is incorporated herein entirely by reference.

BACKGROUND OF THE INVENTION

1. Field of the Invention

The present invention relates to a hairbrush, wherein a porous cylindrical body is formed by curving a plane plate, which is punched in a standard pattern, in the shape of a roll and fixing the both side ends of the mesh plate to each other such that the bristles of a hairbrush can protrude through the holes of the porous cylindrical body and be elastically maintained. Therefore, the manufacturing process of the porous cylindrical body is simplified, reducing the manufacturing costs thereof.

In addition, the parent plate of the porous cylindrical body is made from an alloy of copper such that its electric conductivity is higher than any other metal plate and the thermal conductivity is remarkably higher than any other existing metal. Therefore, a user can fix his or her hair, as desired, in a short time.

Furthermore, according to the present invention, natural bristles are planted and fixed in a fixing frame in such a way that the natural bristles protrude more than the other bristles, which protrude through the mesh holes of the porous cylindrical body, so as to cause wavy hair.

2. Description of the Related Art

In general, a hairbrush is used for doing hair neatly. Hairbrushes are classified according to the shape of the hair desired and the purpose of the use, wherein different hairbrushes are used for causing straight or wavy. Also, different hairbrushes are used for combing, brushing, or drying the hair.

In the case of a brush used for combing the straight hair, a comb formed in a plate shape and having a plurality of ribs is generally used. However, a brush which is used when brushing or drying permed hair, which has waves, has a porous cylindrical body 2 and a plurality of bristles 3 which protrudes from the outer surface of the porous cylindrical body 2, as shown in FIG. 1 to FIG. 4. The porous cylindrical body 2 has a plurality of brush-protrusion holes 4 punched in the outer surface thereof such that bristles 3 can protrude through the plurality of punched brush-protrusion holes 4. The porous cylindrical body 2 has two side ends which are coupled to a handle end part 7, a head end part 8 or the like.

The bristles 3 as above are formed by cutting a thin line of synthetic resin at a predetermined length then twisting and fixing the cut thin line of synthetic resin to a twisted wire so as to form a brush main body 5.

In the brush main body, the wire in a predetermined thickness of approximately 2~2.4 mm is bent in half, wherein one side end of the wire is fixed to a wire twisting machine and the other end is fixed to a spin chuck, and the bristles member 3 made from polyamide fibers is neatly arranged in a gap formed between the folded wire portions. After that, the wire is twisted by the rotation of the spin chuck of the wire twisting machine and simultaneously the bristles member 3 is twisted and fixed to the twisted wire 6 as shown in FIG. 1. In addition, the bristles member 3 extends through the holes of the porous cylindrical body with respect to the twisted wire 6 so as to maintain good elasticity for combing hair.

According to the structure of the prior art of porous cylindrical body 2 as shown in FIG. 4, a cylindrical body in the shape of a pipe is subject to a cutting process to cut the porous cylindrical body 2 in a predetermined length and brush protrusion holes 4 are punched in the peripheral surface of the cylindrical body at a uniform interval.

In the punching process mentioned above, a series of steps must to be carried out such that the brush protrusion holes 4 are individually punched in the peripheral surface of the cylindrical body. Further, a guide is required in order to maintain the original shape of the cylindrical body during the punching process and it is necessary to remove impurities from the punched portions after the punching process. It may also be necessary to individually remove unnecessary portions, such as burrs, which may be generated during the cutting or to carry out an additional work, such as the painting of the cylindrical body, in order to remove the unnecessary portions, thereby increasing manufacturing costs.

The present invention is derived in order to resolve the above and any other problems or disadvantages, and the present invention has an objective to employ an original plate as a constituent element, wherein the plate has mesh holes formed at a uniform interval in a size for elastically maintaining bristles. It is another objective of the present invention to maintain maximum heat flow through the porous cylindrical body from a hair dryer by making the mesh plate of the porous cylindrical body from an alloy material of copper, thereby minimizing time necessary to do the hair.

It is still another objective of the present invention to fix natural bristles in a linear fixing frame such that the natural bristles protrude beyond the bristles which protrude through the mesh holes of the cylindrical body, thus making wavy hair.

SUMMARY OF THE INVENTION

In order to achieve the above objectives, according to one aspect of the present invention, a hairbrush, in which a brush body has bristles which are twisted and fixed to a twisted wire and a porous cylindrical body with holes penetrated at a uniform interval that is coupled to the brush body such that the bristles of the brush body are elastically exposed to the outside of the porous cylindrical body by a predetermined length, is characterized in that: the porous cylindrical body is formed by curving a parent plate in the shape of a roll, which has mesh holes penetrated at a uniform interval, and fixing the both side ends of the mesh plate to each other; and the brush body has the bristles which elastically protrude through the mesh holes of the porous cylindrical body.

According to another aspect of the present invention, a hairbrush, in which a porous cylindrical body which forms the hairbrush is formed by curving a plane plate, which is punched in a standard pattern, in the shape of a roll and fixing the both side ends thereof to each other such that the bristles of the hairbrush protrude through the punched holes of the porous cylindrical body and are maintained with elasticity, is characterized in that: the porous cylindrical body is formed in the shape of a cylinder by curving a plane plate, which has mesh holes penetrated at a uniform interval, in the shape of a roll; a fixing frame is forcedly fitted into the both side ends in the longitudinal direction of the porous cylindrical body so as to connect and fix the both side ends in the longitudinal direction of the porous cylindrical body; and a brush body is fixed in the porous cylindrical body and fixing caps are coupled and fixed to the both side end portions of the porous cylindrical body.

According to the present invention, the fixing frame has a sectional surface which is formed in the shape of an "I" and provided with fitting grooves at both sides thereof such that the both side ends in the longitudinal direction of the porous cylindrical body are fitted into the fitting grooves so as to be fixed thereto.

According to the present invention, natural bristles are planted in the top surface of the fixing frame in the longitudinal direction such that the natural bristles protrude higher than bristles which protrude through the mesh holes of the porous cylindrical body.

According to the present invention, the both side ends in the longitudinal direction of the porous cylindrical body are fitted and fixed into the fitting grooves of the fixing frame and are simultaneously adhered to the fitting grooves of the fixing frame by an adhesive agent provided therebetween. The brush body is thus fixed in the porous cylindrical body, and an adhesive agent is provided between the both side end portions of the porous cylindrical body and the fixing caps.

According to the present invention, the manufacturing process of the porous cylindrical body can be simplified and, accordingly, the manufacturing costs thereof can be reduced.

In addition, the parent plate of the porous cylindrical body is made from an alloy of copper such that the electric conductivity thereof is higher than any other metal plate and the thermal conductivity is remarkably higher than any other existing metal. Therefore, a user can fix his or her hair as desired in a relatively short time when the user combs his or her hair or has his or her hair waved.

Furthermore, the both side ends in the longitudinal direction of the porous cylindrical body which is curved in the shape of a roll are fixed by the fixing frame such that the both side ends in the longitudinal direction of the porous cylindrical body can be fixed in a short time, increasing productivity.

Additionally, according to the present invention, the natural bristles are planted and fixed in a fixing frame in a line such that the natural bristles protrude higher than the bristles, which protrude through the mesh holes of the porous cylindrical body, so as to cause wavy hair.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

Figure 1:
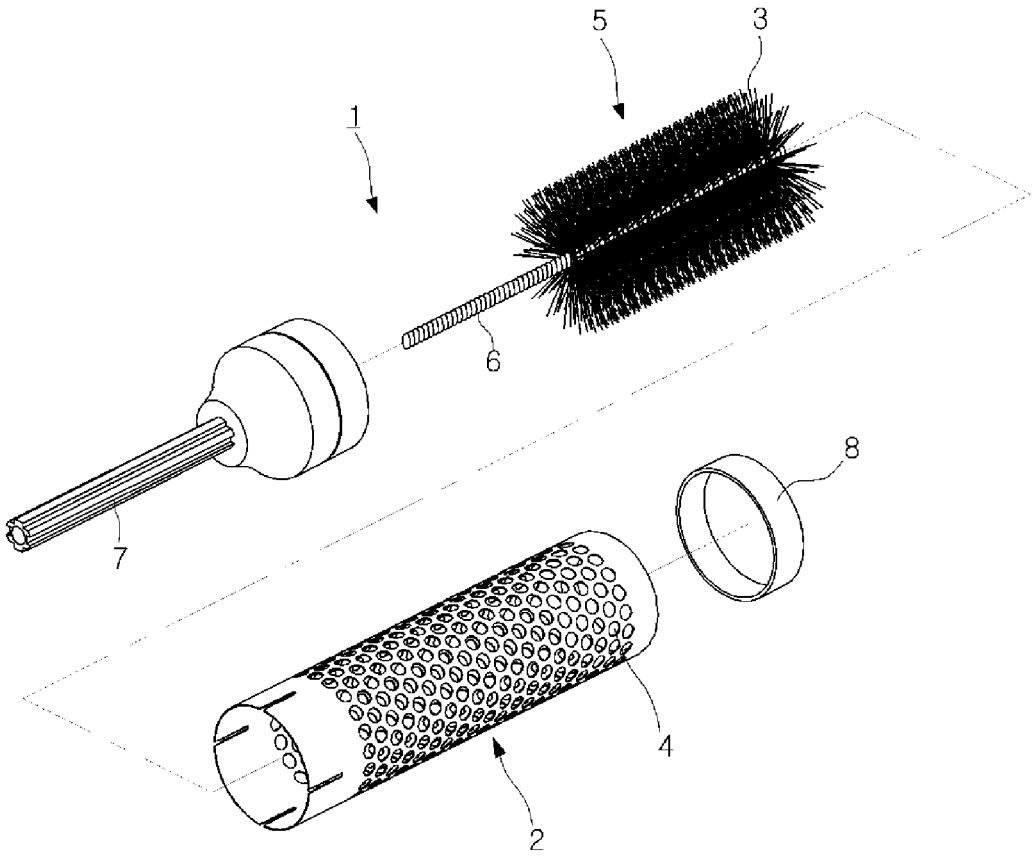
FIG. 1 is a perspective view of a prior art hairbrush in a disassembled state.
Figure 2:
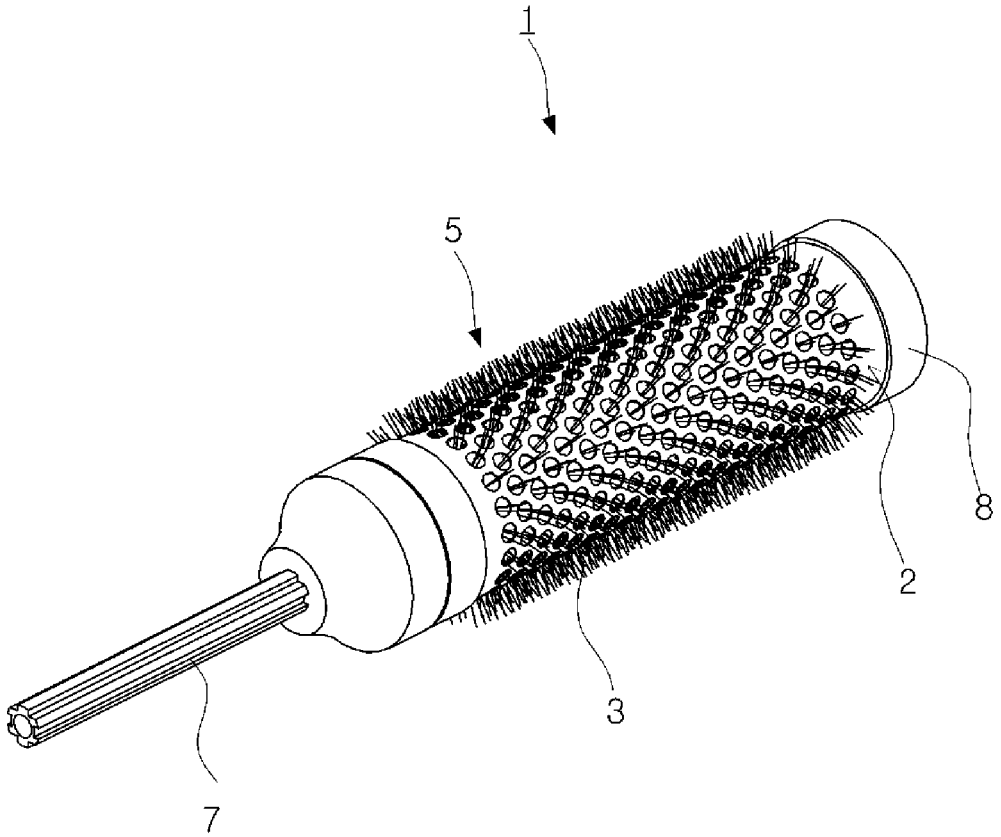
FIG. 2 is a perspective view of a prior art hairbrush.
Figure 3:
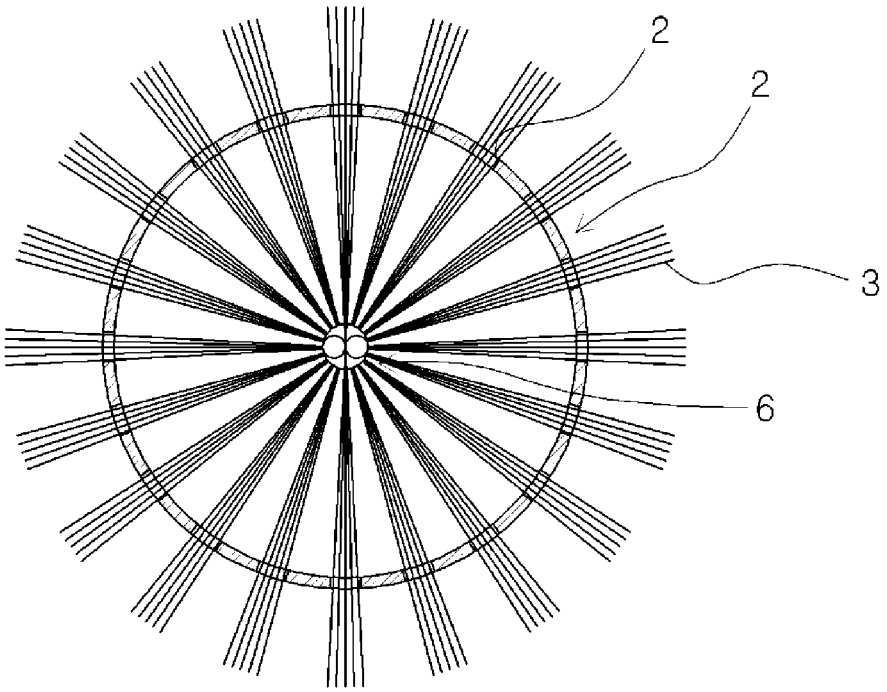
FIG. 3 is a cross-sectional view of a prior art hairbrush.
Figure 4:
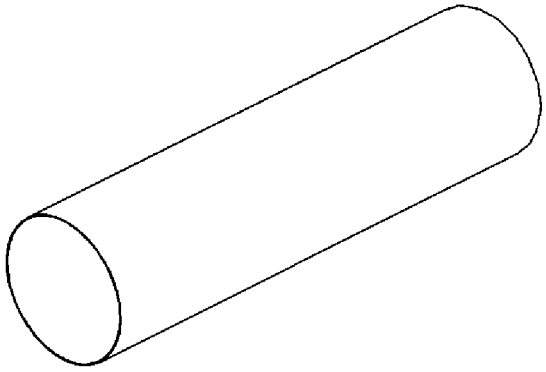
FIG. 4*a*, FIG. 4*b*, FIG. 4*c* are perspective views respectively showing examples of a prior art manufacturing process of a porous cylindrical body.
Figure 4:
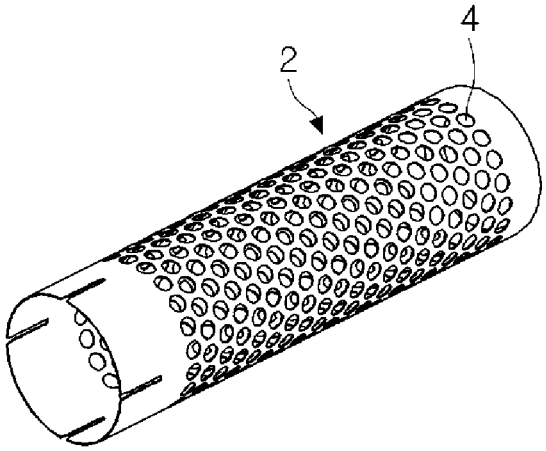
Figure 4:
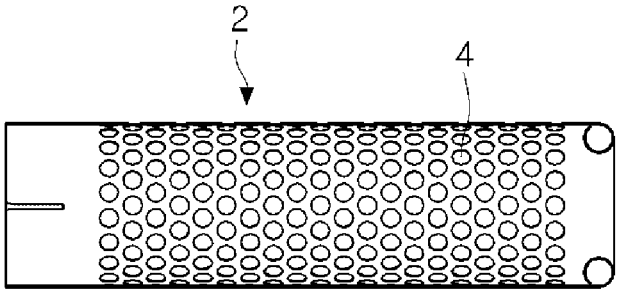

The present disclosure now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In addition, when the elements of each of the figures are denoted by reference numerals, it should be noted that like elements are denoted by like reference numerals although illustrated in different figures. In addition, in the description of the present disclosure, details of well-known configurations or functions may be omitted to avoid unnecessary obscuring the gist of the present disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

Figure 8:
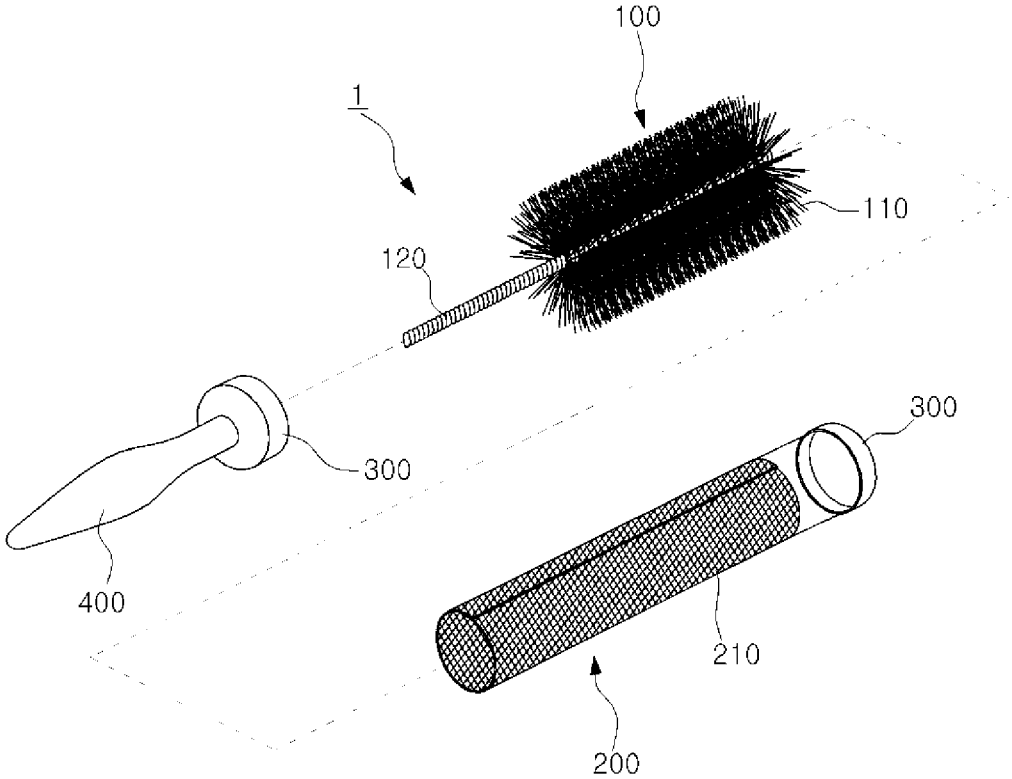
FIG. 8 is a perspective view of a porous cylindrical body according to the present invention in a disassembled state.

As shown in FIG. 8, a hairbrush 1 includes a brush body 100 which is in the shape of a cylinder and provided with bristles 110, a porous cylindrical body 200 which is inserted by the brush body 100 and maintains the bristles 110 with elasticity, fixing caps 300 which are coupled to both end portions of the porous cylindrical body 200, and a handle 400 which extends from the brush body 100 and the fixing caps 300.

In the brush body 100, the bristles 110 are formed by cutting a thin line of synthetic resin at a predetermined length, wherein a plurality of bristles 110 are arranged between two wires and then twisted and fixed by a wire twisting device such that the bristles 110 are twisted on the twisted wire 120 at a uniform interval as shown in FIG. 8 so as to form a cylindrical body.

As for the bristles 110, elastic polyamide fibers or the like can be used.

In the porous cylindrical body 200, a mesh plate 10 is made from an alloy material of copper and provided with mesh holes 210 punched at a uniform interval, and the parent plate 10 is formed in the shape of a cylinder. Therefore, the porous cylindrical body 200 is coupled to the brush body 100 such that the bristles 110 of the brush body 100 can elastically protrude through the mesh holes 210, as shown in FIG. 5 to FIG. 9.

The porous cylindrical body 200 can be made by employing an aluminum alloy. However, the present invention is not limited to such material.

The porous cylindrical body 200 coupled with the bristles 110 of the brush body 100 as above is coupled with fixing caps 300 at both ends, wherein one of the fixing caps 300 is coupled to a handle 400, thereby forming a single hairbrush 1.

Therefore, the bristles 110 of the brush body 100 of the hairbrush 1 protrude in an elastic length through the mesh holes 210 of the porous cylindrical body 200 such that the bristles 110 of the brush body 100 can shape hair as desired by the user.

Figure 5:
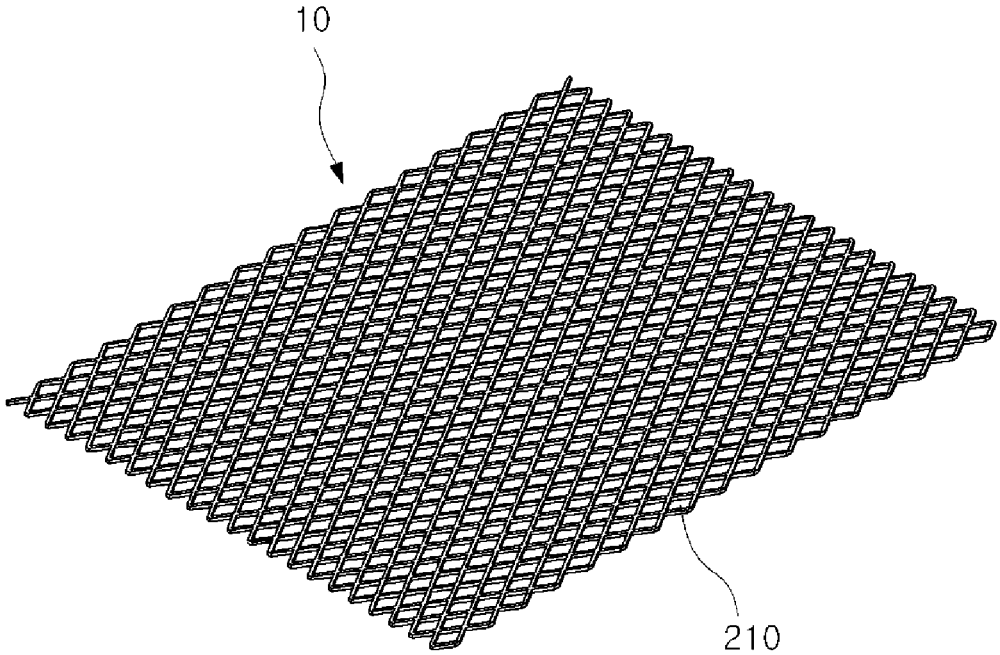
FIG. 5 is a perspective view of a parent plate according to the present invention.
Figure 6:
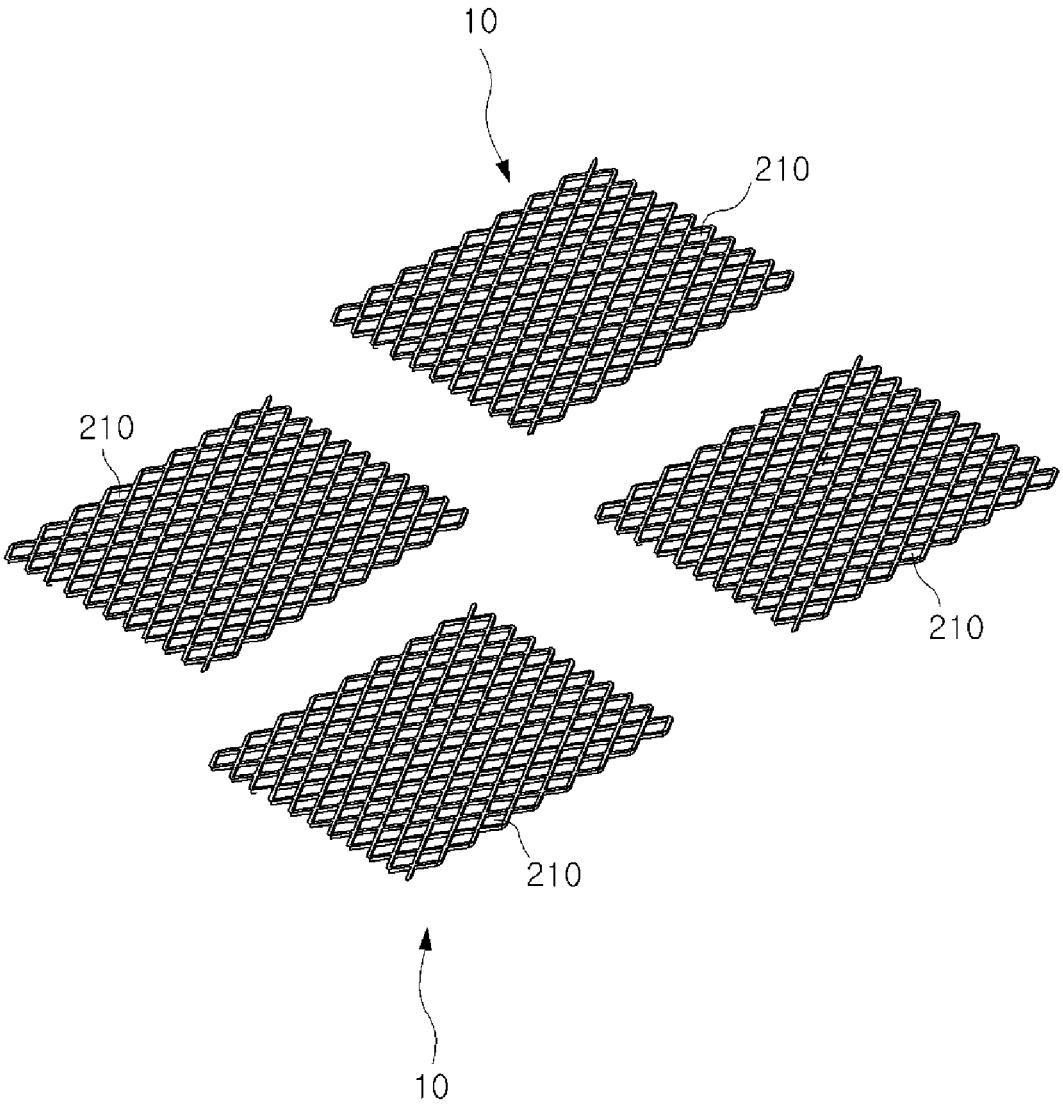
FIG. 6 is a perspective view of a parent plate according to the present invention in a cut state.
Figure 7:
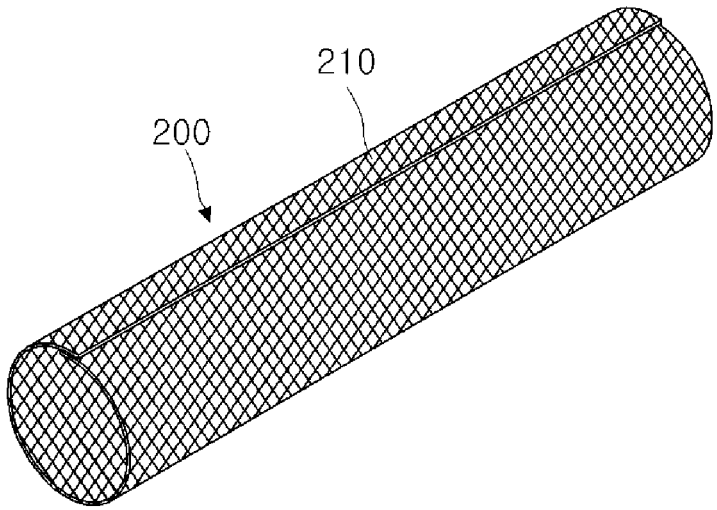
FIG. 7 is a perspective view of a porous cylindrical body according to the present invention.
Figure 9:
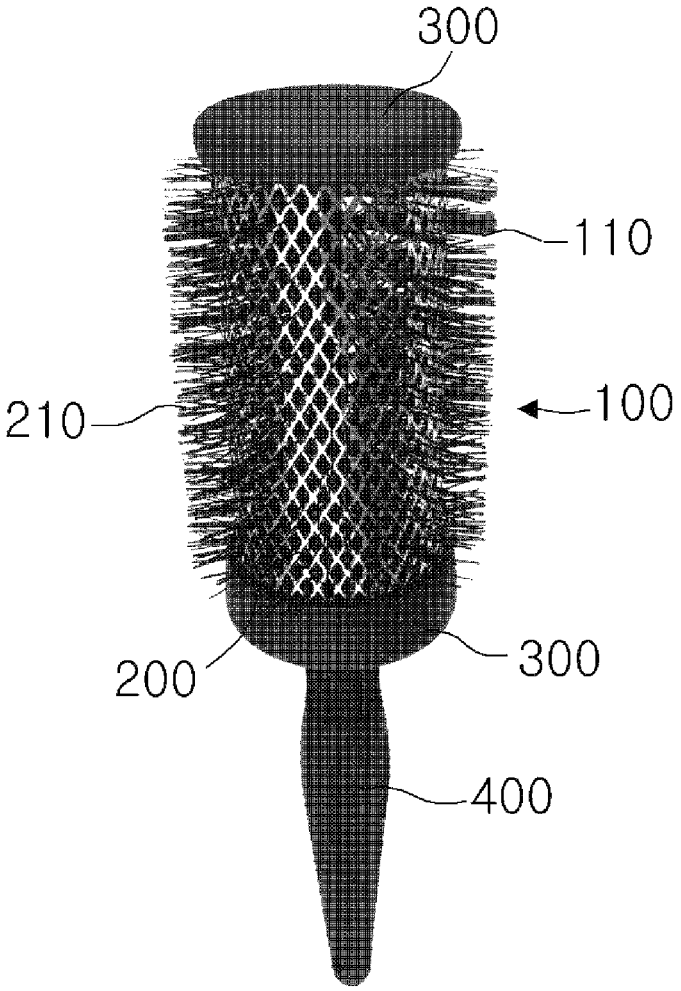
FIG. 9 is a photograph of a hairbrush according to a preferred embodiment of the present invention.

In particular, the hairbrush 1 according to the present invention is provided by a step for punching the mesh holes 210 in the mesh plate 10 at a uniform interval in the formation of the porous cylindrical body 200 as shown in FIG. 5, a step for cutting the mesh plate 10 according to the length and the diameter corresponding to those of the brush body 100 as shown in FIG. 6, a step for forming the porous cylindrical body 200 by curving the cut mesh plate 10 in the shape of a roll and fixing the both side ends of the mesh plate 10 to each other as shown in FIG. 7, and coupling the bristles 110 of the brush body 100 into the mesh holes 210 of the porous cylindrical body 200 such that the bristles 110 of the brush body 100 protrude in an elastic length as shown in FIG. 8 and FIG. 9.

According to the present invention, a method for manufacturing the porous cylindrical body of the hairbrush is subject to the mesh plate punching step, the mesh plate cutting step, the porous cylindrical body forming step, and the bristles coupling step.

The mesh plate 10 provided with the mesh holes 210 which are punched at a uniform interval is made by employing a copper alloy.

The mesh holes 210 of the mesh plate 10 are in a diamond shape. However, it is also possible to employ the shape of a circle or a polygon such as a triangle or a rectangle. Further, the porous cylindrical body 200 can be made by employing an aluminum alloy material.

In addition, the mesh plate 10 is subject to a cutting step such that the mesh plate 10 is cut according to the length and the diameter corresponding to those of the brush body 100 as shown in FIG. 6. The cutting step is carried out under control of the size desired according to the shape of the brush body 100 of the hairbrush 1 to be manufactured by press forming.

The unit body of the cut mesh plate 10 is curved in the shape of a roll and the both side ends of the unit body of the cut mesh plate 10 are fixed to each other so as to carry out the forming step of the porous cylindrical body 200. The both side ends are smoothly fixed by a fixing means such as welding or the like.

The both side ends can be overlapped to each other so as to be joined as shown in FIG. 7, or the ends of the both side end lines of the net can be welded by laser or another process so as to be precisely connected to each other.

The porous cylindrical body 200 is made from a copper alloy as described above. Therefore, it is not necessary to carry out any additional painting or similar process. The porous cylindrical body 200 can be also made from bronze, brass, aluminum bronze, nickel bronze, helium bronze or the like. As for structural material, bronze which is an alloy of tin, bronze which is an alloy of zinc, or the like has been used. It should be noted that the listing of the above materials should not be seen as to limit the scope of the present invention. Other materials may be used without departing from the spirit and scope of the present invention.

In the coupling step, the bristles 110 of the brush body 100 are coupled into the mesh holes 210 of the porous cylindrical body 200 which is formed as above such that the bristles 110 of the brush body 100 can be exposed in an elastic length.

In particular, the copper and the copper alloy in the present invention have excellent electric conductivity, thermal conductivity, and corrosion resistance. That is, the copper alloy has high electric conductivity and high thermal conductivity. The excellent conductivities are the most important properties. The copper alloy material usually has conductivity of about 101~102%.

Therefore, in the present invention, the mesh plate 10 having the uniformly punched mesh holes 210 is made from the copper alloy material so as to form the porous cylindrical body 200, such that the porous cylindrical body 200 can maintain the best of the heat generated by a hair dryer.

In particular, the porous cylindrical body 200 made from the copper alloy material in the present invention has high electric conductivity and thermal conductivity and is thus remarkably superior rather than any other existing metal. Therefore, a user can have the hair styled as desired in a short time.

In addition, the porous cylindrical body 200 made from the copper alloy material has the antibacterial function of the copper itself. Therefore, it is possible to prevent the sticking and the propagation of virus/germs and any other microorganism from the copper surface, wherein the porous cylindrical body 200 made from the copper alloy material has the excellent antibacterial function but does not exhibit any toxicity to human bodies.

Furthermore, the porous cylindrical body 200 made from the copper alloy material has good corrosion resistance. Therefore, no surface corrosion or the damage to the brush can happen even in the case of the hair styling together with the use of hair-styling chemicals such as hair mousse or the like.

Figure 10:
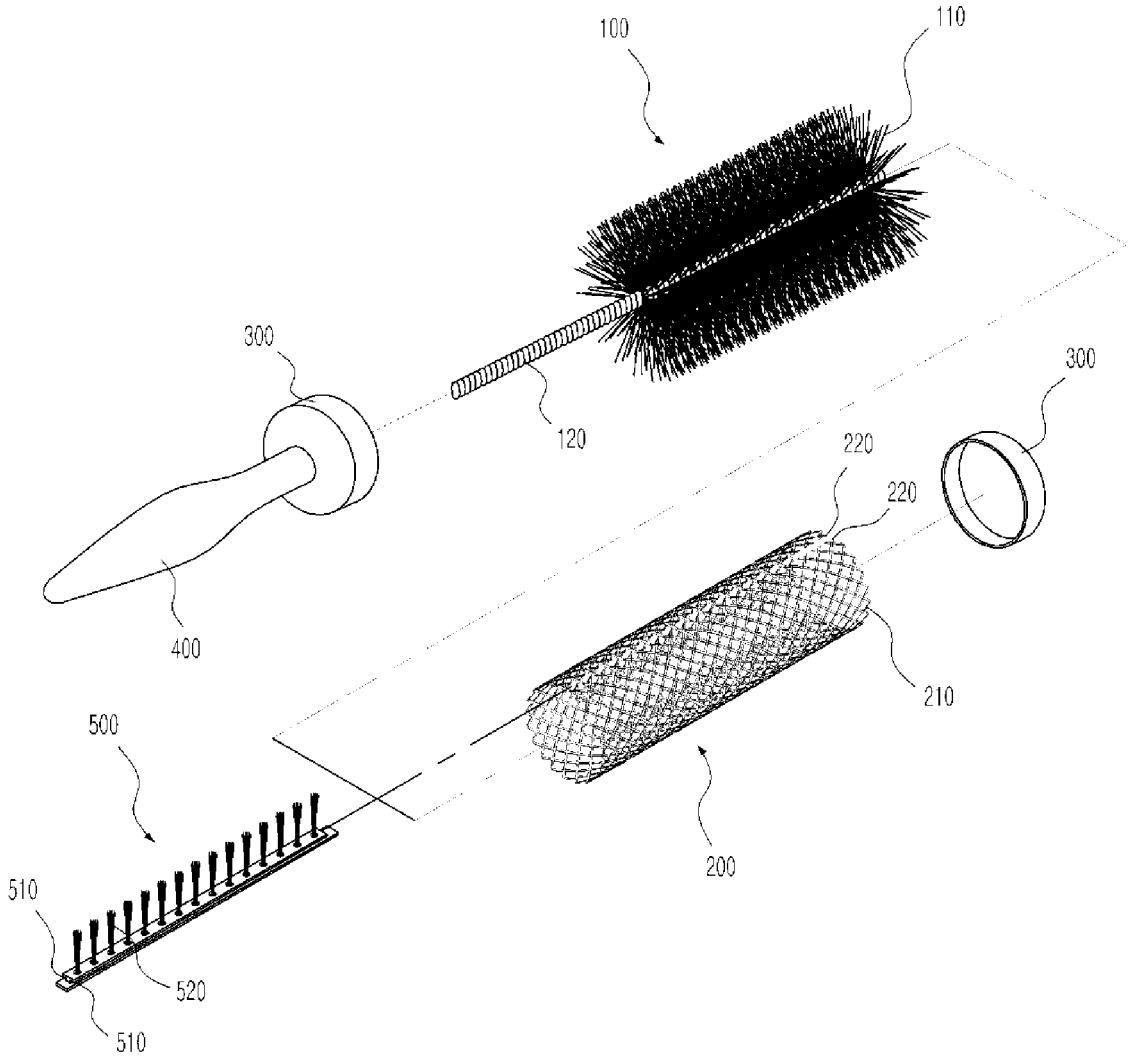
FIG. 10 is a perspective view of a hairbrush according to another preferred embodiment of the present invention in a disassembled state.

As an alternative embodiment as shown in FIG. 10, the hairbrush 1 includes a brush body 100 which is provided with bristles 110 in the shape of a cylinder, a porous cylindrical body 200 which is inserted by the brush body 100 and maintains the bristles 110 with elasticity, fixing caps 300 which are coupled to both end portions of the porous cylindrical body 200, and a handle 400 which is coupled to a twisted wire 120 described hereinafter and integrally formed with fixing caps 300.

In the brush body 100, a wire in a predetermined thickness of approximately 2~2.4 mm is bent in half, wherein one side end of the wire is fixed to a wire twisting machine (not shown) and the other end is fixed to a spin chuck, and the bristles 110 made from polyamide fibers are neatly arranged in a gap formed between the folded wire portions. After that, the wire is twisted by the rotation of the spin chuck of the wire twisting machine and simultaneously the center portion of the bristles 110 is twisted and fixed to the twisted wire 120.

In addition, the brush body 100 is coupled to the porous cylindrical body 200 and the bristles 110 of the brush body 100 extend through the mesh holes 210 of the porous cylindrical body 200 to the outside of the porous cylindrical body 200 by a predetermined length so as to maintain good elasticity for combing hair.

The porous cylindrical body 200 is made from a copper alloy material having excellent thermal conductivity and is formed by rolled a mesh plate in the shape of a cylinder, which has mesh holes 210 penetrated at a uniform interval, and fixing the both side ends in the longitudinal direction of the mesh plate to a fixing frame 500 by forcedly fitting the both side ends into the fixing frame 500 as described hereinafter such that the porous cylindrical body 200 is finished in a cylindrical shape having a section in the shape of a circle.

In addition, the brush body 100 is coupled into the porous cylindrical body 200 and the bristles 110 of the brush body 100 are coupled into the mesh holes 210 of the porous cylindrical body 200 such that the bristles 110 of the brush body 100 can protrude in an elastic length.

Further, the porous cylindrical body 200 can be made by employing an aluminum alloy material which has excellent thermal conductivity.

The porous cylindrical body 200 coupled with the bristles 110 of the brush body 100 as above is coupled with fixing caps 300 at both ends, wherein one of the fixing caps 300 is coupled to a handle 400 and the other one is in a circular shape.

The twisted wire 120 of the brush body 100 is coupled to the inside of the handle 400 which is integrally fixed to the fixing cap 300 at one end portion of the porous cylindrical body 200.

Therefore, the bristles 110 of the brush body 100 of the hairbrush 1 are coupled into the mesh holes 210 of the porous cylindrical body 200 such that the bristles 110 of the brush body 100 can protrude through the mesh holes 210 of the porous cylindrical body 200 in an elastic length. Thus, the bristles 110 of the brush body 100 style the hair of a user as desired when the user is combing the hair with the hairbrush.

In the formation of the porous cylindrical body 200 according to the present invention, the mesh plate which has the mesh holes 210 punched at a uniform interval is curved in the shape of a roll such that the porous cylindrical body 200 can be formed in a cylindrical shape.

Further, the fixing frame 500 has a sectional surface which is formed in the shape of an "I" and provided with fitting grooves 510 at both sides thereof and natural bristles 520 are planted in the top surface of the fixing frame 500 in the longitudinal direction.

Figure 11:
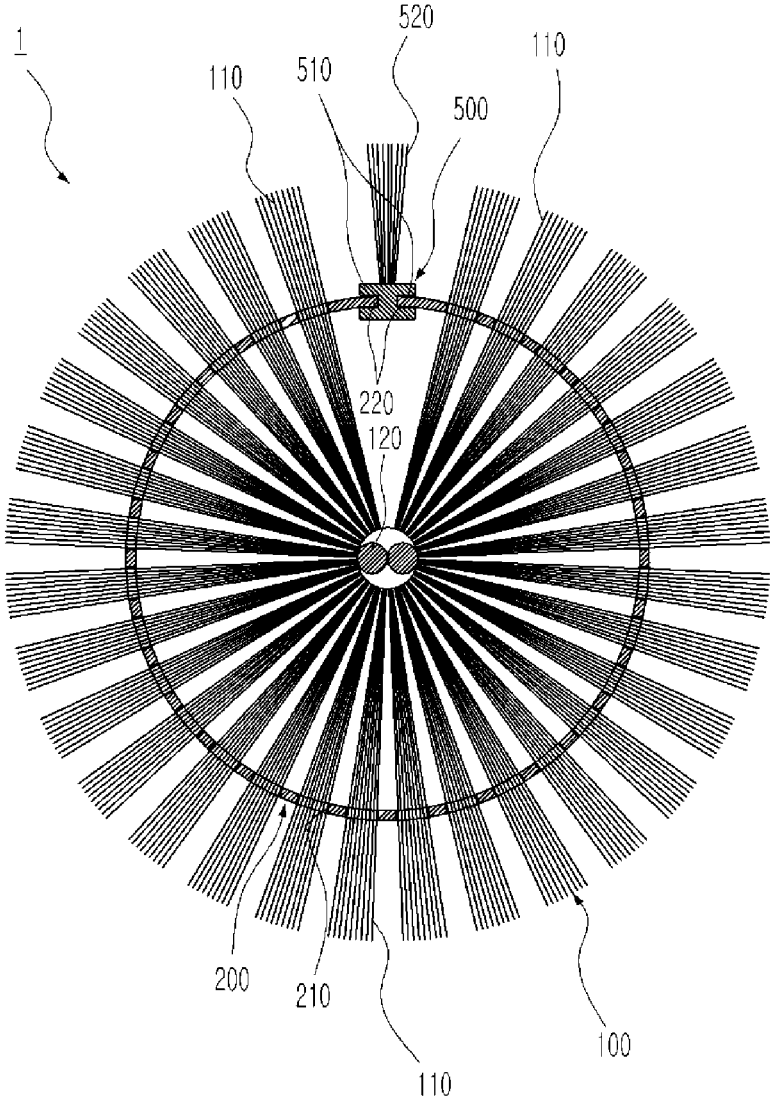
FIG. 11 is a cross-sectional view of the hairbrush according to the embodiment of FIG. 10.

Referring to FIG. 10 and FIG. 11, the both side ends 220 in the longitudinal direction of the porous cylindrical body 200 are fitted into the fitting grooves 510 of the fixing frame 500 so as to be fixed thereto. Therefore, the both side ends 220 of the porous cylindrical body 200 are fixed to the fixing frame 500.

The porous cylindrical body 200 is formed to be curved in the shape of a cylindrical roll such that both ends in the longitudinal direction of the porous cylindrical body 200 have forced applied in the longitudinal direction. Therefore, the both ends in the longitudinal direction of the porous cylindrical body 200 apply force towards the fixing frame 500 such that the fixing frame 500 can be maintained and fixed.

In order to more perfectly fix the fixing frame 500 to the porous cylindrical body 200, the both ends in the longitudinal direction of the porous cylindrical body 200 are fitted and fixed into the fitting grooves 510 of the fixing frame 500 and simultaneously an adhesive agent is applied to the portions between the both ends in the longitudinal direction of the porous cylindrical body 200 and the fitting grooves 510 of the fixing frame 500 such that the fixing frame 500 can be integrally fixed and maintained to the porous cylindrical body 200.

Referring to FIG. 11, the natural bristles 520 which are planted in the top surface of the fixing frame 500 in the longitudinal direction protrude higher than the bristles 110 of the brush body 100 which protrude through the mesh holes 210 of the porous cylindrical body 200 when the brush body 100 is coupled in the porous cylindrical body 200.

The natural bristles 520 which protrude higher than the bristles 110 of the brush body 100 can have the hair more naturally waved, wherein the natural bristles 520 are formed of animal hair so as to have the hair naturally waved.

As described hereinabove, according to the present invention, the one end portion of the porous cylindrical body 200 which is coupled to the brush body 100 is coupled to the fixing cap 300 which is provided with the handle 400 and the other end portion is fixed with the circular fixing cap 300.

Figure 12:
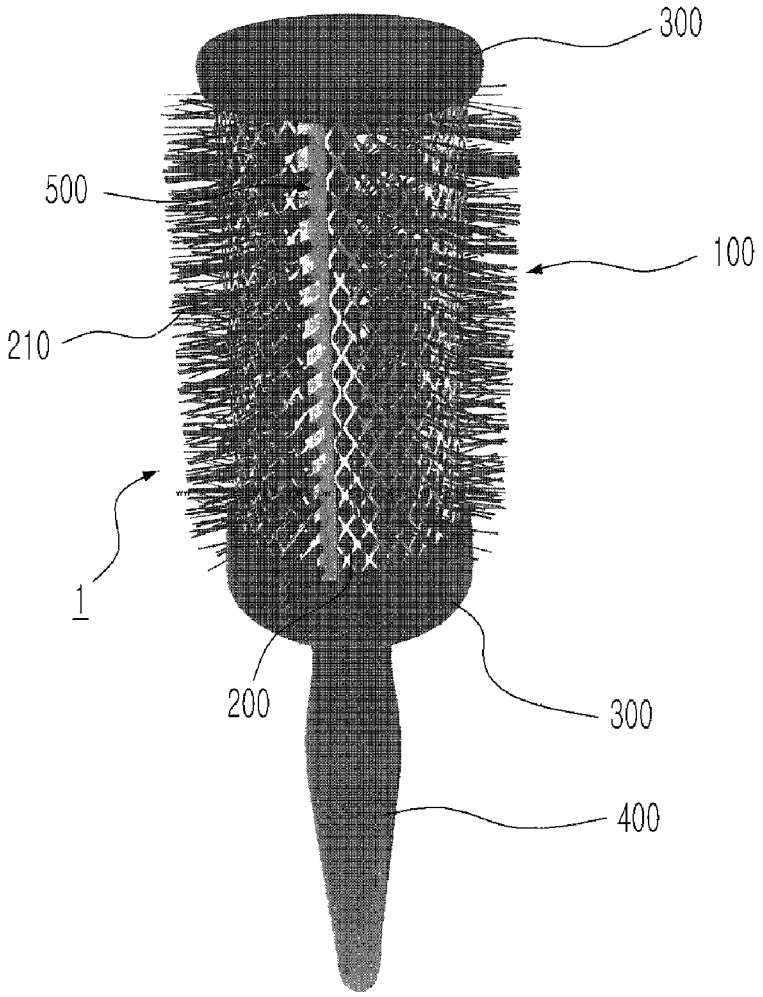
FIG. 12 is a photograph of the hairbrush according to the embodiment of FIG. 10.

The fixing cap 300 which is integrally provided with the handle 400 is fixed to the one side end portion of the porous cylindrical body 200 while the twisted wire 120 of the brush body 100 is coupled to the inside of the handle 400 which is integrally fixed to the fixing cap 300, such that the assembling of the hairbrush 1 is finished as shown in FIG. 12.

Meanwhile, in order to completely fix the fixing caps 300 to the porous cylindrical body 200 in the present invention, the adhesive agent can be applied to the portions between the both end portions of the porous cylindrical body 200 and the fixing caps 300.

The porous cylindrical body 200 is made from a copper alloy as described above. Therefore, it is not necessary to carry out any additional painting or the like. The porous cylindrical body 200 can be also made from bronze, brass, aluminum bronze, nickel bronze, helium bronze or the like. As for structural material, bronze which is an alloy of tin, bronze which is an alloy of zinc, or the like has been used. It should be noted that the listing of the above materials should not be seen as to limit the scope of the present invention. Other materials may be used without departing from the spirit and scope of the present invention.

In particular, the copper and the copper alloy which are the main materials of the porous cylindrical body 200 in the present invention have excellent electric conductivity and thermal conductivity and the corrosion resistance thereof is generally great. That is, the copper alloy has high electric conductivity and thermal conductivity. The excellent conductivities are the most important properties. The copper alloy material usually has conductivity of about 101~102%.

Therefore, in the present invention, the mesh plate 10 having the uniformly punched mesh holes 210 is made from the copper alloy material so as to form the porous cylindrical body 200, such that the porous cylindrical body 200 can maintain the best of the heat generated by a hair dryer.

In particular, the porous cylindrical body 200 made from the copper alloy material in the present invention has high electric conductivity and thermal conductivity and is thus remarkably superior to any other existing metal. Therefore, a user can have the hair styled as desired in a short time.

In addition, the porous cylindrical body 200 made from the copper alloy material has the antibacterial function of the copper itself. Therefore, it is possible to prevent the sticking and the propagation of virus/germs and any other microorganism from the copper surface, wherein the porous cylindrical body 200 made from the copper alloy material has the excellent antibacterial function but does not exhibit any toxicity to human bodies.

Further, the porous cylindrical body 200 made from the copper alloy material has good corrosion resistance. Therefore, no surface corrosion or damage to the brush can happen even in the case of the hair styling together with the use of hair-styling chemicals such as hair mousse or the like.

The above description only exemplifies the technical spirit of the present disclosure, and it will be understood by those skilled in the art to which the present disclosure pertains that various modifications and changes may be made without departing from the essential characteristics of the present disclosure. Accordingly, the embodiments disclosed in the present disclosure are not intended to limit but describe the technical spirit of the present disclosure, and the range of the technical spirit of the present disclosure is not limited by the embodiments. The protection range of the present disclosure should be interpreted by the appended claims, and all technical spirits within the equivalent scope should be interpreted as being included in the scope of the present disclosure.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A hairbrush, in which a porous cylindrical body which forms the hairbrush is formed by curving a plane plate, which is punched in a standard pattern, in the shape of a roll and fixing the both side ends thereof to each other such that the bristles of the hairbrush are exposed through the punched holes of the porous cylindrical body and maintained with elasticity, characterized in that:

the porous cylindrical body is formed in the shape of a cylinder by curving a mesh plate, which has mesh holes penetrated at a uniform interval, in the shape of a roll;

a fixing frame is forcedly fitted into the both side ends in the longitudinal direction of the porous cylindrical body so as to connect and fix the both side ends in the longitudinal direction of the porous cylindrical body; and a brush body is fixed in the porous cylindrical body and fixing caps are coupled and fixed to both end portions of the porous cylindrical body, wherein natural bristles are planted in a top surface of the fixing frame in the longitudinal direction such that the natural bristles protrude higher than bristles which protrude through the mesh holes of the porous cylindrical body.

2. The hairbrush of claim 1, wherein the both side ends in the longitudinal direction of the porous cylindrical body are fitted and fixed into fitting grooves of the fixing frame and simultaneously the both side ends in the longitudinal direction of the porous cylindrical body are adhered to the fitting grooves of the fixing frame by an adhesive agent provided therebetween, the brush body is fixed in the porous cylindrical body, and an adhesive agent is provided between the both end portions of the porous cylindrical body and the fixing caps.

3. The hairbrush of claim 1, wherein the porous cylindrical body is made of aluminum alloy.

4. The hairbrush of claim 1, wherein the porous cylindrical body is made of copper alloy.

5. A hairbrush, in which a porous cylindrical body which forms the hairbrush is formed by curving a plane plate, which is punched in a standard pattern, in the shape of a roll and fixing the both side ends thereof to each other such that the bristles of the hairbrush are exposed through the punched holes of the porous cylindrical body and maintained with elasticity, characterized in that:

the porous cylindrical body is formed in the shape of a cylinder by curving a mesh plate, which has mesh holes penetrated at a uniform interval, in the shape of a roll;

a fixing frame is forcedly fitted into the both side ends in the longitudinal direction of the porous cylindrical body so as to connect and fix the both side ends in the longitudinal direction of the porous cylindrical body; and a brush body is fixed in the porous cylindrical body and fixing caps are coupled and fixed to both end portions of the porous cylindrical body, wherein the fixing frame has a sectional surface which is formed in the shape of an "I" and provided with fitting grooves at both sides thereof such that the both side ends in the longitudinal direction of the porous cylindrical body are fitted into the fitting grooves so as to be fixed thereto, wherein natural bristles are planted in a top surface of the fixing frame in the longitudinal direction such that the natural bristles protrude higher than bristles which protrude through the mesh holes of the porous cylindrical body.

6. The hairbrush of claim 5, wherein the both side ends in the longitudinal direction of the porous cylindrical body are fitted and fixed into the fitting grooves of the fixing frame and simultaneously the both side ends in the longitudinal direction of the porous cylindrical body are adhered to the fitting grooves of the fixing frame by an adhesive agent provided therebetween, the brush body is fixed in the porous cylindrical body, and an adhesive agent is provided between the both end portions of the porous cylindrical body and the fixing caps.

7. The hairbrush of claim 5, wherein the porous cylindrical body is made of aluminum alloy.

8. The hairbrush of claim 5, wherein the porous cylindrical body is made of copper alloy.

* * * * *